US005370453A

United States Patent [19]

Wolff

[11] Patent Number: 5,370,453

[45] Date of Patent: Dec. 6, 1994

[54] JEWELRY ORGANIZER

[75] Inventor: Stacy L. Wolff, Akron, Ohio

[73] Assignee: Rubbermaid Inc., Wooster, Ohio

[21] Appl. No.: 995,967

[22] Filed: Dec. 23, 1992

[51] Int. Cl.[5] ..... G09F 21/06

[52] U.S. Cl. ..... 312/217; 312/289; 312/290; 312/321.5; 206/6.1

[58] Field of Search ..... 312/216, 217, 218, 220, 312/221, 284, 286, 287, 289, 290, 321.5, 326, 327, 328, 329; 206/6.1, 493, 566; 211/13

[56] References Cited

U.S. PATENT DOCUMENTS

| | | | |
|---|---|---|---|
| 379,166 | 3/1888 | Hunter | 312/270.2 |
| 3,092,428 | 6/1963 | Kerschner | 312/218 |
| 3,930,702 | 1/1976 | Pichowicz | 206/566 X |
| 3,942,851 | 3/1976 | Kaplan . | |
| 4,214,797 | 7/1980 | Borresen et al. | 312/284 X |
| 4,324,446 | 4/1982 | Le Sage | 206/566 X |
| 4,616,891 | 10/1986 | Jantzen . | |
| 4,776,650 | 10/1988 | Ferenzi | 211/13 X |
| 4,811,996 | 3/1989 | Hansson | 206/566 X |
| 5,048,902 | 9/1991 | Daly | 312/321.5 X |
| 5,069,342 | 12/1991 | Dickinson | 312/216 X |
| 5,104,208 | 4/1992 | Gesing | 312/321.5 |

OTHER PUBLICATIONS

P. 7 of Akro-Mills brochure, Akro-Mills, Akron, Ohio 44308; 1979.

P. 13 of Flambeau brochure, Flambeau, P.O. Box 5067, Columbus, Ind. 47202; 1987.

Catalog page, EZ-Sort Bins, Bush Lake Industries, 4571 Valley Industrial Blvd., South Shakopee, Minn. 55379; 1986.

Catalog page, Organizers, Plano Molding Company, Plano, Ill. 60545-0189; 1991.

Pp. 8, 10 and 11 of Contico catalog, Contico Manufacturing Co., a division of Continental International, 1101 Warson Road, St. Louis, Mo. 63132; 1990-91.

Patent drawings; Rubbermaid Incorporated, 1147 Akron Road, Wooster, Ohio 44691; the product depicted herein is the subject of currently pending application Ser. No. 07/897,971 filed Jun. 15, 1992.

*Primary Examiner*—Brian K. Green

*Attorney, Agent, or Firm*—Renner, Kenner, Grieve, Bobak, Taylor & Weber

[57] ABSTRACT

A jewelry organizer (10) includes a housing preferably formed on interconnected housing portions (11, 12). The front of the organizer (10) is provided with an assembly of bins (70) which, when released by a release mechanism (25) open to provide access to the contents of the bins (70). Side doors (53) are hingedly attached to one housing portion (12) and have a hook (60) thereon to carry hangable items of jewelry. A rear open compartment (42) likewise has hooks (51, 52) to carry similar items of jewelry. Like the bins (70), a top compartment (63) having a pivotal cover (64) can also carry smaller items of jewelry.

13 Claims, 6 Drawing Sheets

JEWELRY ORGANIZER

TECHNICAL FIELD

This invention relates to a container for storing items such as jewelry and the like in an organized fashion. More particularly, this invention relates to a portable container which is compact yet uniquely configured to provide a variety of jewelry organizing compartments, each being specially adapted to contain particular types of jewelry.

BACKGROUND ART

Most portable containers specifically designed to store jewelry or the like are merely low profile, box-like structures having a hinged cover which takes up space on the vanity or other surface and which, once opened, exposes the entire jewelry contents of the container. While sub-compartments or other storage-assisting devices are often found in the container, nevertheless, all of the jewelry is usually exposed when the cover is opened. Moreover, items such as necklaces, chains and the like can often become tangled even if there is a separate compartment within which they can lay. In addition, other smaller items such as rings, earrings and the like can be undesirably intermixed in the prior art jewelry boxes unless care is taken to separate the same.

The only other commonly employed jewelry-holding device is what is sometimes referred to as a jewelry tree. In this device an upstanding pedestal has a number of arms extending generally radially outward therefrom near the top thereof. Items of jewelry, such as chains, necklaces and the like, can be hung in a somewhat organized fashion from these arms. While taking up less space, such devices are, of course, not only limited by their application only to hangable items of jewelry, but also the items so hung are always exposed and are thus more susceptible to loss or damage.

DISCLOSURE OF THE INVENTION

It is thus a primary object of the present invention to provide a jewelry storing device which is adapted to hold a wide variety of jewelry or like items in an organized fashion.

It is another object of the present invention to provide a jewelry storing device, as above, which can hold a large volume of items in a confined area thereby requiring less surface space to support the device.

It is a further object of the present invention to provide a jewelry storing device, as above, which has a multiplicity of chambers or jewelry holding containers.

It is an additional object of the present invention to provide a jewelry storing device, as above, in which each chamber or container is specially adapted to hold jewelry items of a particular type or configuration.

These and other objects of the present invention, as well as the advantages thereof over existing prior art forms, which will become apparent from the description to follow, are accomplished by the improvements hereinafter described and claimed.

In general, a device for holding articles of jewelry or the like includes a housing and a plurality of compartments within the housing for holding the articles. One of the compartments is in the form on an assembly of bins having open tops and pivotal from a closed position generally flush with the housing to an open position extending outward from the housing.

In accordance with other aspects of the invention, another of the compartments is in the form of at least one door which is hingedly attached to the housing. The door includes a member to hold articles on the door. Another of the compartments is formed near the top of the housing and a cover, pivotally attached to the housing, closes this compartment. An open compartment is also formed in the housing and has a member positioned thereon to support articles confined in the open compartment.

A preferred exemplary jewelry organizer incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
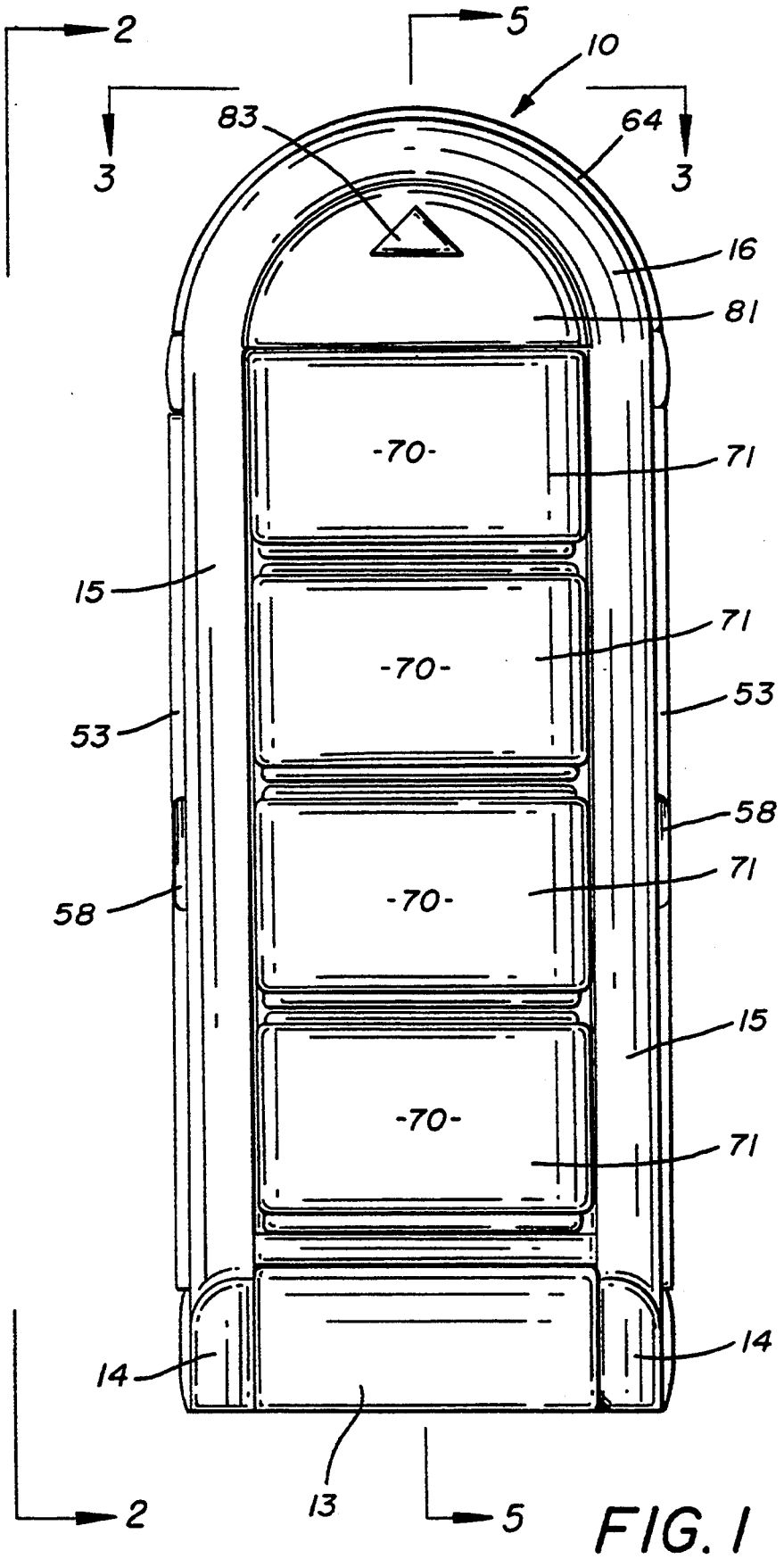
FIG. 1 is a front elevational view of a jewelry organizer made in accordance with the concepts of the present invention.

A jewelry organizer made in accordance with the concepts of the present invention is indicated generally by the numeral 10 in the drawings. Jewelry organizer 10 is preferably constructed of any suitable injection molded plastic, such as polypropylene, and for ease of molding and assembly is preferably molded in two portions, a front housing portion generally indicated by the numeral 11, and a rear housing portion generally indicated by the numeral 12.

Figure 2:
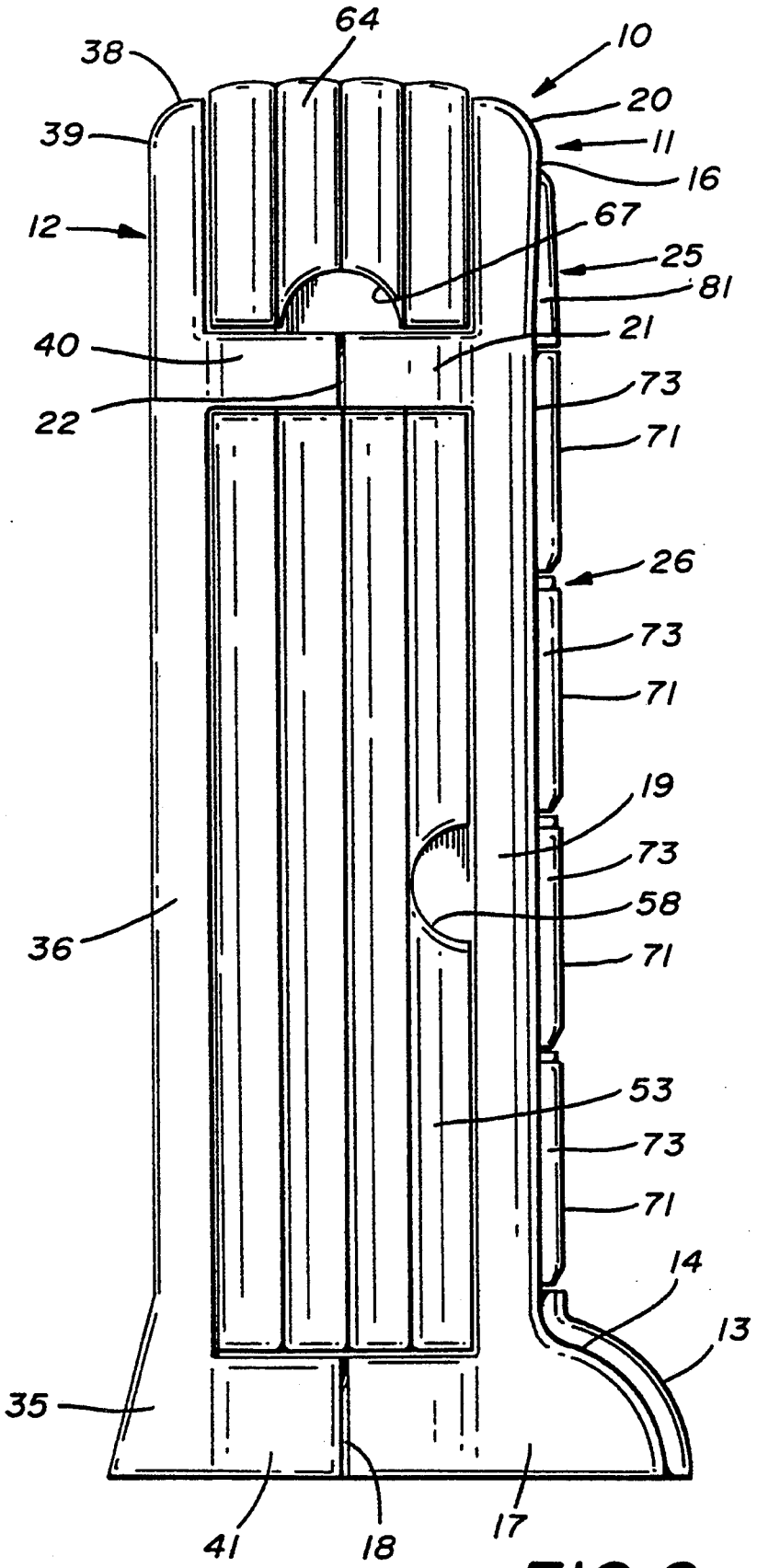
FIG. 2 is a side elevational view taken substantially along line 2—2 of FIG. 1.

Front housing portion 11 includes a lower front pedestal base 13 having sculptured side wings 14 which turn upwardly to form opposed upright front corner walls 15 joined at the top by a front arch wall 16. As best shown in FIG. 2, a lower side skirt 17 extends rearwardly from each wing 14 terminating at a lower parting line 18 between front housing portion 11 and rear housing portion 12. Opposed upright front corner side walls 19 extend upwardly from each lower side skirt 17 and blend with front corner walls 15 to form the front outer corners of jewelry organizer 10. Front corner side walls 19 are joined at the top by a front top arch wall 20 which blends with front arch wall 16. Upper side skirts 21 extend rearwardly from front corner side walls 19 terminating at an upper parting line 22 between front housing portion 11 and rear housing portion 12.

Figure 5:
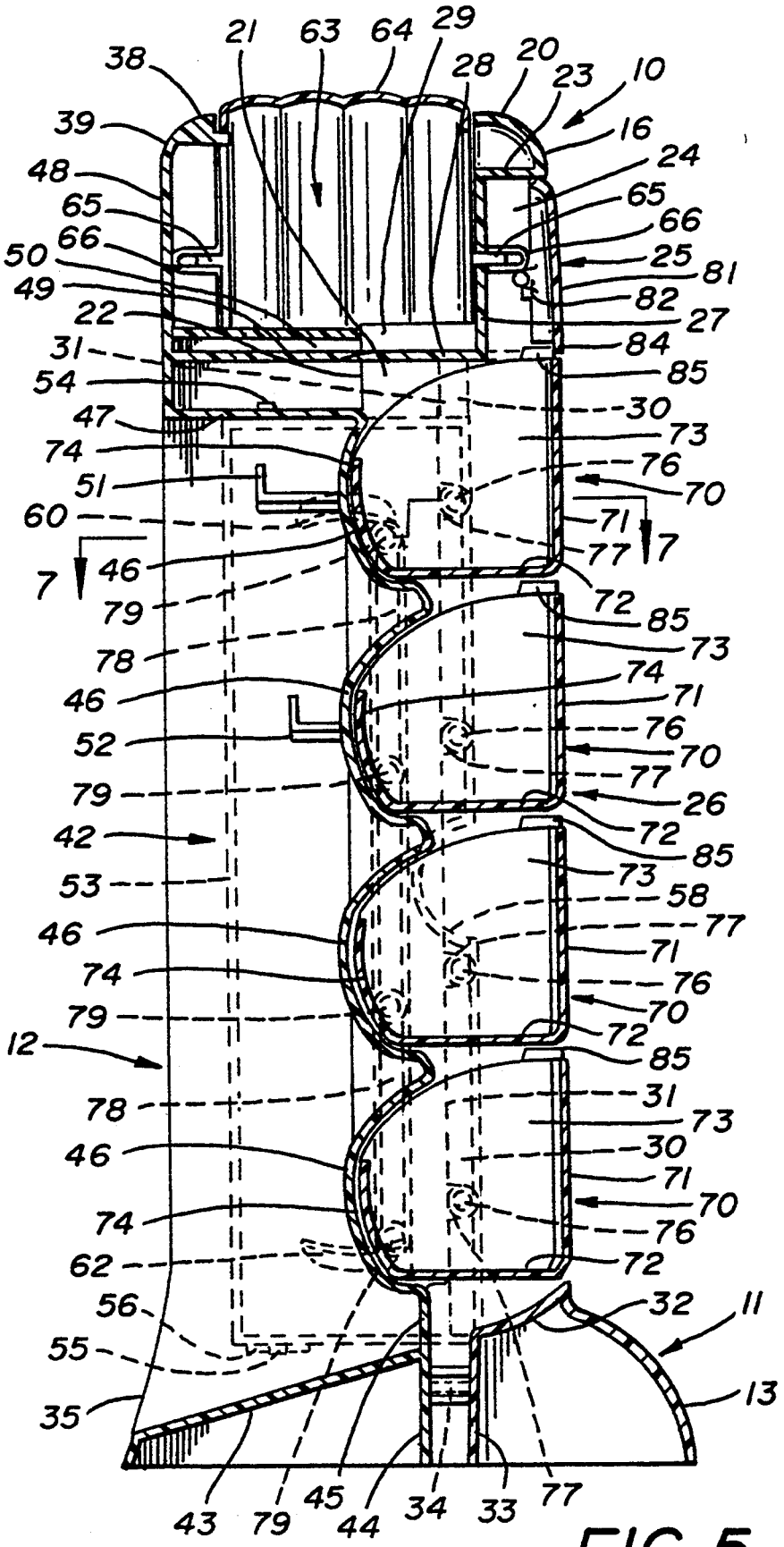
FIG. 5 is a sectional view taken substantially along line 5—5 of FIG. 1.
Figure 6:
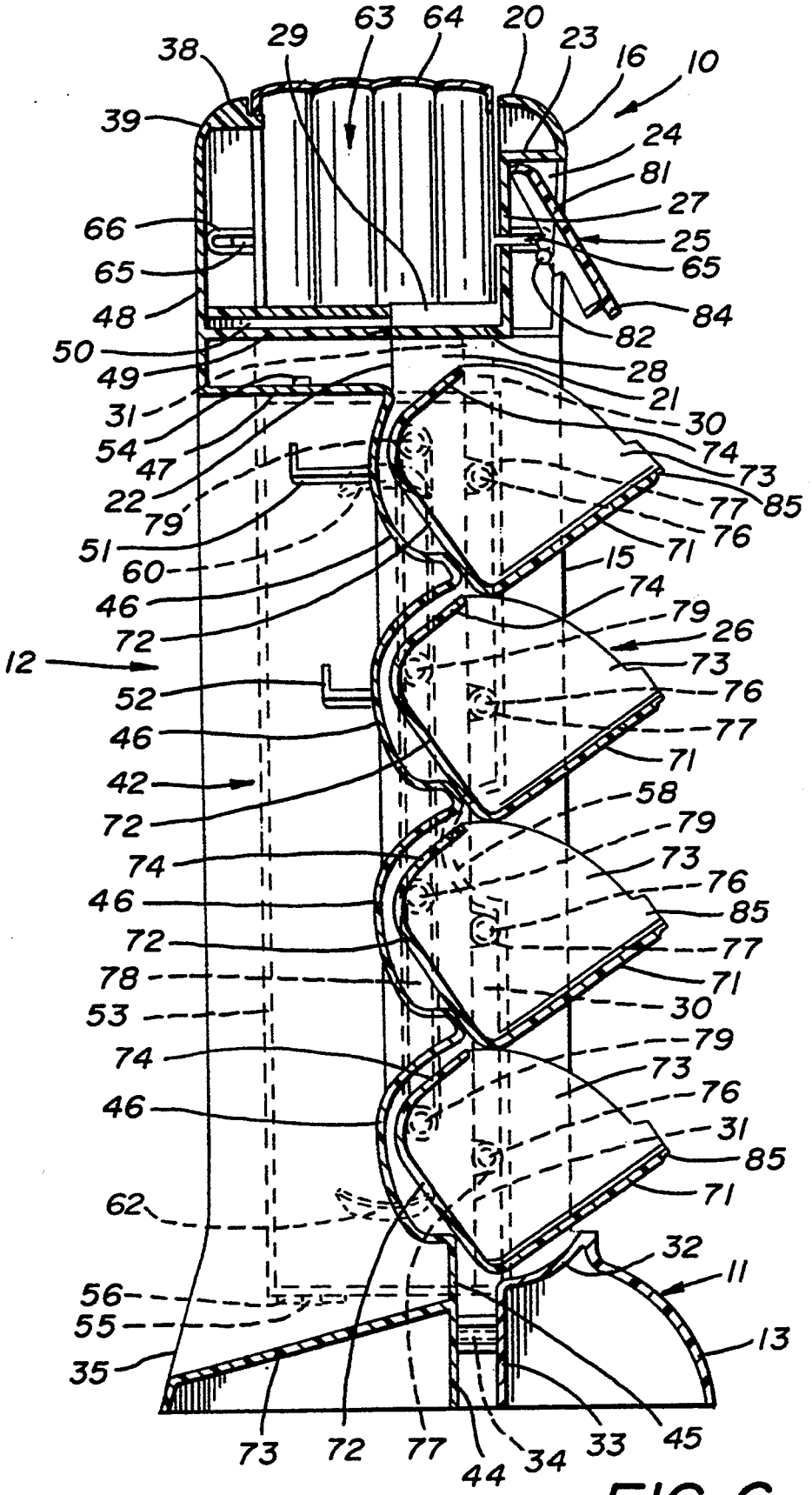
FIG. 6 is a sectional view similar to FIG. 5 but showing the front compartments of the jewelry organizer in an open position.

As best shown in FIGS. 5 and 6, a wall 23 extends rearwardly from the lower arcuate portion of arch wall 16 to define the top of a recessed chamber 24 which receives a bin release mechanism assembly, generally indicated by the numeral 25, which as will be hereinafter described, serves to release an assembly of front bins generally indicated by the numeral 26. A generally vertical inner wall 27 extends downwardly from wall 23 to define the back wall for recessed chamber 24. The bottom of wall 27 turns inwardly or rearwardly to form wall 28, and carries a cylindrical socket 29 which, as will hereinafter be described, is adapted to engage rear housing portion 12.

Wall 28 also serves as the top wall for a recess housing bin assembly 26, which recess is defined on the sides by walls 30, which extend rearwardly from the inside edges of front corner walls 15 and terminate at edge 31. The bottom of the recess which houses bin assembly 26 is defined by an arcuate wall 32 extending rearwardly from the top of pedestal base 13. At a point internally spaced from side wall skirt 17, a generally vertical wall 33 extends downwardly from the lower end of arcuate wall 32 and carries a portion of a snap-fitting connector 34 which can be any conventional item known in the art which enables front housing portion 11 to be joined at the bottom with rear housing portion 12, the configuration of which will now be described.

As best shown in FIG. 2, rear housing portion 12 includes a rear angled pedestal base 35, opposed to front pedestal base 13 which, with pedestal base 13, provides standing stability to jewelry organizer 10. Opposed upright rear corner side walls 36 extend upwardly from rear pedestal base 35 and blend with rear corner walls 37 (FIG. 7) to form the rear corners of jewelry organizer 10. Rear corner side walls 36 are joined at the top by a rear top arch wall 38 opposite front top arch wall 20. Rear top arch wall 38 blends with a rear arch wall 39 opposite to front arch wall 16. As shown in FIG. 2, upper side skirts 40 extend forwardly from rear corner side walls 36 terminating at parting line 22 and adjacent to upper side skirts 21 of front housing portion 11. Similarly, lower side skirts 41 extend inwardly from rear pedestal 35 and terminate at lower parting line 18 adjacent to lower side skirts 17 of front housing portion 11.

As best shown in FIGS. 5 and 6, an open compartment 42 is formed in the rear of jewelry organizer 10 between the vertical rear corner walls 37. An internal floor 43 which extends angularly upwardly from rear pedestal 35 forms the bottom of compartment 42. At the uppermost point of floor 43, a downwardly directed generally vertical wall 44 opposes wall 33 of front housing portion 11 and carries the mating portion of snap-fitting connector 34. The rear wall 45 of compartment 42, which is also the front wall of rear housing portion 12 and, in addition, the rear wall for the recess which houses bin assembly 26, extends vertically upwardly from the innermost point of floor 43 and includes a plurality of undulations 46.

A rearwardly directed generally horizontal wall 47 extends from the top of wall 45, just above the top undulation 46 thereof, back out to the rear periphery of jewelry organizer 10. A vertical wall 48 extends upwardly from wall 47 and joins rear arch wall 39 to form an enclosed back of the top of jewelry organizer 10 generally opposed to the front area defined by bin release mechanism assembly 25. A second generally horizontal wall 49 is spaced from and positioned just above wall 47 to carry a cylindrical plug member 50 to be received in socket 29 of front housing portion 11. The engagement of plug member 50 and socket 29 hold front housing portion 11 and rear housing portion 12 together at the top thereof, as does snap-fitting connector 34 at the bottom thereof, so that jewelry organizer 10 may be assembled as one unit.

When so assembled, jewelry organizer 10 is adapted to carry a wide variety of jewelry items in a plurality of compartments and in an organized fashion as now to be described. First, larger or longer items of jewelry, such as necklaces, chains and the like, may be stored in the open rear compartment 42, as desired. To this end, a hook 51 (FIGS. 5 and 6) may extend outwardly from wall 45 from, for example, the top undulation 46 thereof. As such, a necklace or chain may be hung on hook 51 and thereby be confined within compartment 42. Similarly, one or more additional hooks may be located within compartment 42. Thus, as shown, a second, lower hook 52 can extend from wall 45, such as from the next lowest undulation 46 thereof, to hold additional, potentially shorter, items of jewelry. When such is provided, it is preferable to have upper hook 51 extend further outward from wall 45 than lower hook 52, as shown, so that items hung from hook 51 will not interfere with items hung from hook 52. In addition, it should be evident that other jewelry holding items could be positioned within compartment 42. For example, finger posts could extend into compartment 42 from lower of the undulations 46 of wall 45 to hold items such as rings or the like.

Figure 3:
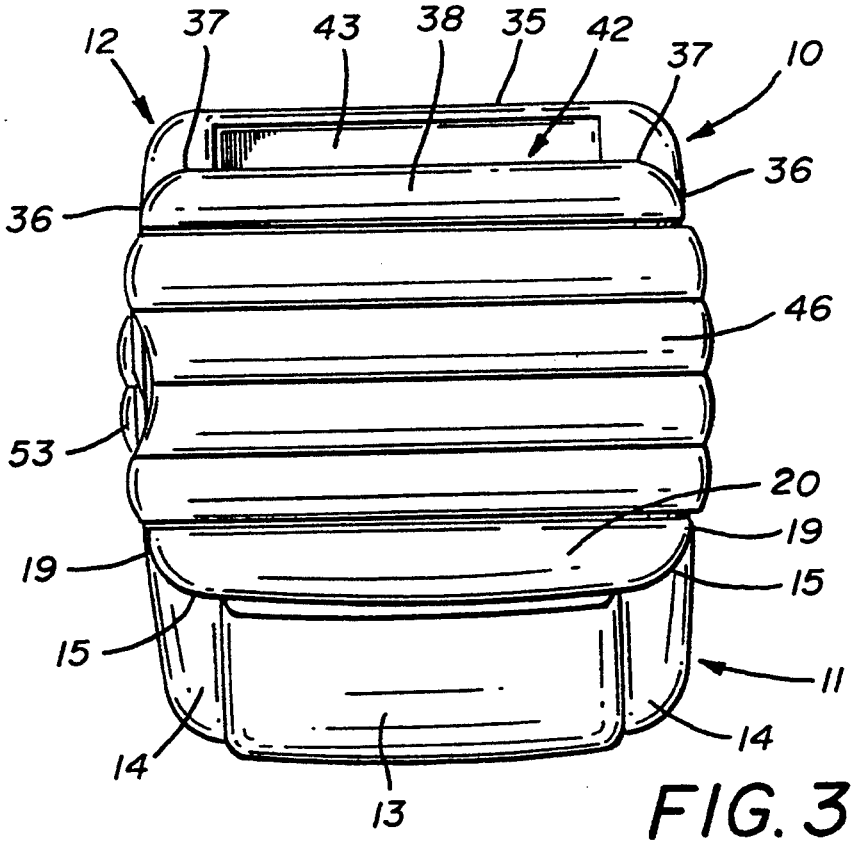
FIG. 3 is a top plan view taken substantially along line 3—3 of FIG. 1.
Figure 4:
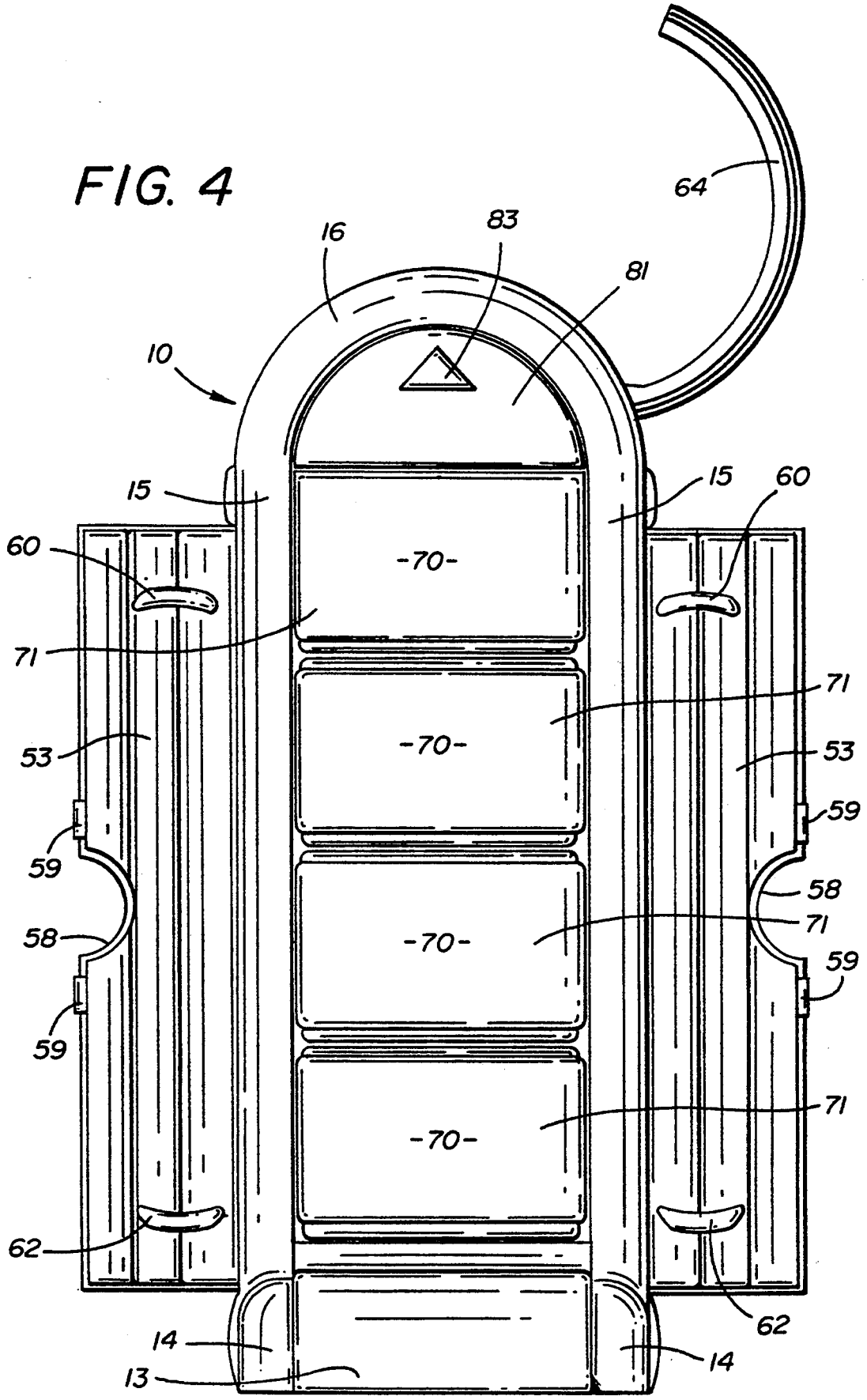
FIG. 4 is a front elevational view similar to FIG. 1 but showing the top door and the side doors of the jewelry organizer in an open position.

As best shown in FIGS. 2 and 3, side doors 53 are also provided to carry longer items of jewelry in a more concealed fashion. Each door 53 is positioned laterally between front corner side walls 19 and rear corner side walls 36 and vertically between upper side skirts 21, 40 and lower side skirts 17, 41. Each door 53 is provided with an upper hinge pin 54 (FIGS. 5 and 6) received through wall 47 for pivoting thereon and a lower hinge pin 55 received through an aperture in tabs 56 carried by side skirts 41. A finger recess 58 is formed on each door on the side opposite to that which it is hinged so that doors 53 can be conveniently swung open to the FIG. 4 position. As shown in FIG. 4, lugs 59 on each side of finger recess 58 provide for the snap engagement of doors 53 to front side corner walls 19.

Internally, each door is also provided with upper hooks 60 upon which chain-like items of jewelry may be hung. When the door is then closed, such items will be confined in the small compartments 61 shown in FIG. 7. If desired, lower hooks 62 may also be provided inside of doors 53 as the mirror image of hooks 60. These hooks not only allow doors 53 to be used interchangeably in the manufacturing and assembly process, but also give doors 53 the versatility of being able to hold elastic items of jewelry, such as pony-tail holders, with the same being stretched between hooks 60 and 62.

Small items of jewelry such as rings, earrings, barrettes, brooches and the like may be housed at the top of jewelry organizer 10. To this end, a top compartment 63 is formed between front top arch wall 20 and rear top arch wall 38 having its bottom defined by walls 28 and 49 and having its top closed off by a pivotal arcuate cover 64. Each side of cover 64 is provided with a pivot pin 65 received in cylindrical lugs 66 (FIGS. 5 and 6) associated with walls 48 and 27. Thus, cover 64 may be pivoted from the FIG. 1 or FIG. 2 position to the position shown in FIG. 4, and a finger recess 67 assists the user in such pivotal movement. When in the FIG. 4 position, items of jewelry may readily be positioned in compartment 63 formed under cover 64.

Other small items of jewelry may be segregated in bin assembly 26 now to be described in detail. Bin assembly 26 includes a plurality of bins 70 positioned in the front surface of jewelry organizer 10 in a vertically stacked arrangement and preferably manufactured of a styrene material. For ease of manufacturing and assembly, each bin 70 is identical in configuration having a planar front wall 71, which is generally vertically oriented when bins 70 are in the closed position shown, for example, in FIGS. 1 and 5, and thus generally flush with the front of front housing portion 11. Each bin 70 also includes a planar bottom surface 72 which is generally horizontally oriented when bins 70 are in the closed position. Bins 70 also include opposed side walls 73 having an arcuate top surface, side walls 73 being spanned or otherwise connected at the front by wall 71 and at the rear by an arcuate rear wall 74 extending upwardly from the rear of bottom surface 72. The top rim of front wall 71, side walls 73 and rear wall 74 thus define an open top for each bin 70 which only becomes exposed when bins 70 are in the FIG. 6 position. Moreover, as shown in FIG. 5, the arcuate shape of rear wall 74 and the arcuate top of side walls 73 generally parallel or complement the curvilinear configuration of undulations 46 of wall 45 of rear housing portion 12.

Each bin 70 is rendered pivotal with respect to the other members of jewelry organizer 10 by means of pivot pins 75 which extend outward from each side wall 73 and are received in apertures 76 in bosses 77 which extend outwardly from edge 31 of walls 30 of front housing portion 11. As such, bins 70 are pivotal on an axis defined by pins 75.

Figure 7:
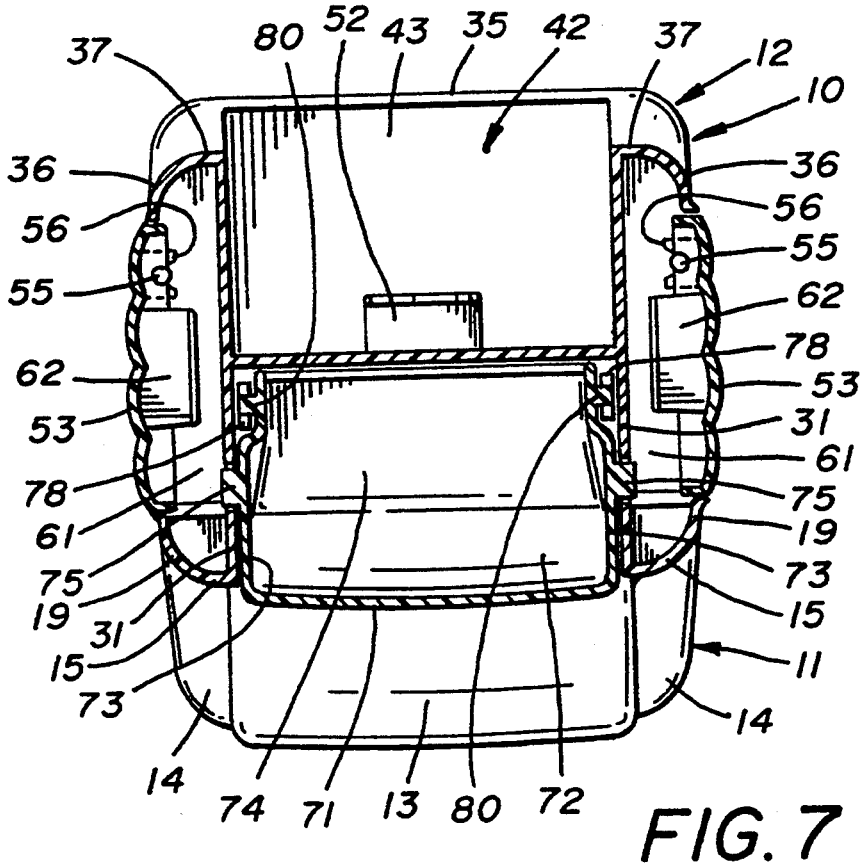
FIG. 7 is a sectional view taken substantially along line 7—7 of FIG. 5.

Such pivoting occurs in unison by virtue of the fact that all of the bins are tied together by a link arm 78 (FIGS. 5, 6, 7). Link arm 78 is provided with a plurality of spaced apertures 79 which engage lugs 80 extending from near the rear of each bin side wall 73 near back wall 74. As such, when one bin 70 pivots from the FIG. 5 to the FIG. 6 position, as shown, all bins 70 will pivot with link arm 78 moving upwardly.

By virtue of the configuration of bins 70, their center of gravity is laterally offset from the pivot point defined by pins 75 and thus, if not restrained, they would normally be positioned in the open condition depicted in FIG. 6. Latch release assembly 25 prohibits that natural movement of bins 70 and includes a plate member 81 having pivot lugs 82 extending laterally from each side thereof and into the lower portion of front arch wall 16. Thus, plate member 81 is pivotable within recessed chamber 24 from the FIG. 5 to the FIG. 6 position by pushing the top thereof. For convenience of the user, plate member 81 may carry an indicia 83, shown in FIGS. 1 and 4 as being in the form of a triangle or arrow, to indicate to the user where plate member 81 is to be pushed to release bins 70.

The lower end of plate member 81 has a lip 84 extending downwardly therefrom which engages a lug 85 formed on the top of the front wall 71 of the top bin 70. As shown, and as previously indicated, for ease of manufacture and interchangeability, all bins 70 have a lug 85, but only the lug 85 of the top bin 70 is engaged by lip 84 of plate member 81. Thus, when in the FIG. 5 position, all bins 70 are restrained from pivoting by virtue of their interconnection through link arm 78. But by manually rotating plate member 81 to the FIG. 6 position, the upper bin 70 is released and all bins 70 fall by gravity to the open position to expose the contents thereof.

It should thus be appreciated that jewelry organizer 10 is capable of holding a wide variety of jewelry in a segregated and compact fashion, larger, elongate items being carried in rear compartment 42 and on doors 53 within compartments 61, and smaller items being segregated in top compartment 63 and bins 70. All of this is accomplished in a relatively small space rendering jewelry organizer 10 completely portable and not taking up much usable counter space. For example, the preferred jewelry organizer 10 shown is only approximately six inches wide and five inches deep, standing fifteen inches high, thereby utilizing very little counter space but efficiently holding adequate quantities of jewelry. Thus, a jewelry organizer constructed in accordance with the teachings herein accomplishes the objects of the present invention and substantially improves the art.

I claim:

1. Apparatus for holding articles in an organized fashion comprising a housing, and a plurality of compartment means within said housing for holding articles, one of said plurality of compartment means including a bin assembly including a plurality of bins having an open top, pivot means to permit said bins to be pivotal by gravity from a closed position generally flush with said housing to an open position extending outward from said housing, and means which is pivoted to release said bins to permit said bins to pivot by gravity on said pivot means from the closed position to the open position said means to release including a plate pivotally connected to said housing, lug means on at least one of said bins, and a lip on said plate to engage said lug means such that upon pivoting of said plate, said lip disengages said lug means and releases said bins.

2. Apparatus according to claim 1 further comprising a link arm attaching said bins together so that when said one of said bins is released by said means to release all of said bins will move from a closed position to an open position.

3. Apparatus according to claim 1, a second of said plurality of compartment means including at least one door hingedly attached to said housing, said door having means to carry articles thereon.

4. Apparatus according to claim 3, said housing having a top, a third of said plurality of compartment means including a compartment formed near said top of said housing, and cover means pivotally attached to said housing and pivoted to provide access to said compartment.

5. Apparatus according to claim 4, a fourth of said plurality of compartment means including an open compartment formed in said housing, and means positioned within said open compartment to carry articles therein.

6. Apparatus according to claim 1, said housing having a top, a second of said plurality of compartment means including a compartment formed near said top of said housing, and cover means pivotally attached to said housing and pivoted to provide access to said compartment.

7. Apparatus according to claim 6, a third of said plurality of compartment means including an open compartment formed in said housing, and means positioned within said open compartment to carry articles therein.

8. Apparatus according to claim 1, a second of said plurality of compartment means including an open compartment formed in said housing, and means positioned within said open compartment to carry articles therein.

9. Apparatus according to claim 8, a third of said plurality of compartment means including at least one door hingedly attached to said housing, said door having means to carry articles thereon.

10. Apparatus according to claim 8, said open compartment having a back wall which is also the back wall of a recess housing said bin assembly.

11. Apparatus according to claim 1 wherein said housing is formed from a first housing portion and a second housing portion and further comprising means to connect said housing portions, said bin assembly being carried in said first housing portion.

12. Apparatus for holding articles in an organized fashion comprising a housing having a front wall, side walls, a rear wall and an open top, a plurality of bins pivotally carried in said front wall, a door hingedly attached to each of said side walls and having means to carry articles thereon, a compartment formed by said open top, a cover for closing said open top thereby closing said compartment formed by said open top, and a permanently open compartment formed in said rear wall, said permanently open compartment having means to carry articles therein.

13. Apparatus for holding articles in an organized fashion comprising a housing, a plurality of compartment means within said housing for holding articles, one of said plurality of compartment means including a bin assembly including a plurality of bins having an open top, pivot means to permit said bins to be pivotal from a closed position generally flush with said housing to an open position extending outward from said housing, and means to release said bins to permit said bins to pivot on said pivot means from a closed position to an open position, said means to release including a plate pivotally connected to said housing, lug means on at least one of said bins, and a lip on said plate to engage said lug means such that upon pivoting of said plate, said lip disengages said lug means and releases said bins.

* * * * *